US005551493A

United States Patent [19]

Sonntag et al.

[11] Patent Number: 5,551,493

[45] Date of Patent: Sep. 3, 1996

[54] FILLING APPARATUS WITH TRAVELING NOZZLE

[75] Inventors: Donald W. Sonntag, Titusville; James Bonner, Flemington, both of N.J.

[73] Assignee: Reagent Chemical & Research, Inc., Middlesex, N.J.

[21] Appl. No.: 286,871

[22] Filed: Aug. 5, 1994

[51] Int. Cl.[6] ..... B67C 3/26; B67C 3/24

[52] U.S. Cl. ..... 141/263; 141/260; 141/374; 222/378

[58] Field of Search ..... 141/146, 147, 141/152, 177, 258, 260, 261, 263, 264, 286, 374; 222/378, 379

[56] References Cited

U.S. PATENT DOCUMENTS 3,005,473 10/1961 Ring ..... 141/86
3,040,787 6/1962 Knoll ..... 141/146
3,056,436 10/1962 Fechheimer et al. ..... 141/263
4,235,265 11/1980 Feliks ..... 141/264
4,817,683 4/1989 Laub, III et al. ..... 141/258

*Primary Examiner*—Henry J. Recla
*Assistant Examiner*—Steven O. Douglas
*Attorney, Agent, or Firm*—Timothy J. Martin; Michael R. Henson

[57] ABSTRACT

An apparatus dispenses flowable material from a source and includes a dispensing nozzle that reciprocates along an axis. A metering assembly includes a metering cylinder, a metering element reciprocally movable in the interior of the metering cylinder and a switching valve to switch the metering assembly between a metering mode wherein material flows into the metering cylinder and thereby displaces the metering element and a discharge mode. A metering element drive moves the metering element into the metering cylinder during the discharge mode to displace material thereby to dispense material through dispensing nozzle. A lift bracket is mounted for common equidistant movement with the metering element, and the dispensing nozzle is interconnected to the lift bracket for equidistant movement in one direction.

34 Claims, 7 Drawing Sheets

FILLING APPARATUS WITH TRAVELING NOZZLE

FIELD OF THE INVENTION

The present invention broadly relates to dispensing equipment operative to place material in a container. More specifically, however, the present invention concerns dispensing equipment used to meter and dispense a product into a container for packaging and sale. The present invention is particularly useful wherein the product to be packaged is of medium to high viscosity.

BACKGROUND OF THE INVENTION

As the world's population increases, the need to supply goods and services becomes increasingly complex. In order to adequately distribute products, it is necessary that they be sufficiently packaged to protect the integrity of the product, to provide a uniform quantity, to facilitate transport storage and display and to increase convenience to the purchaser/user.

Various industries employ a wide variety of packaging techniques for their various goods. Examples of such packaging techniques include boxes and cartons, paper and plastic bags, jars and bottles, metal cans, tubes, shrink wrapping and blister packs to name a few. A particular problem arises where a manufacturer seeks to package viscous materials. For example, where a viscous material is metered into a container, air can become entrapped in cavities resulting in either a short fill of the package or an overflow condition which fouls the dispensing equipment. This is of particular concern with viscous materials since, due to their relatively high surface tension, the materials tend to cling together and to the dispensing equipment with which they become in contact.

Examples of viscous materials for which accurate dispensing has value may be found in the food industry and include such viscous products as butter, peanut butter, jellies, cheeses, etc. In the cosmetic and personal hygiene industry, these viscous materials may include thick lotions, gels, creams, toothpastes, shampoos and the like. Household chemicals include such diverse products such as shoe polish, greases, soaps, hand cleaners and the like. In the industrial chemical industry, examples of viscous materials may include greases and other petroleum products, sealants, adhesives and a host of other products. All of these industries experience difficulties with automated packaging equipment, and the present invention is directed to providing improved dispensing equipment for these industries, although this invention is not limited to these industries, alone.

Many containers used by manufacturers to package their product are cylindrical in shape having hollow interiors within which to receive dispensed product for package. The present invention is particularly adaptable to these types of packages, whether they be cans, bottles or, as is often the case, a squeeze tube container also known as the "toothpaste-tube" container. In such squeeze tubes, an elongated tubular body is closed at one end, for example, by a nozzle or spout that defines a downstream end for the tube, when finished, out of which product is dispensed by a user. Product is filled in such tube from the spout end upwardly to an open end by a dispensing nozzle. The open end is then sealed by a crimping or heat sealed process flattening the upstream end of the squeeze along a diameter thereof. Due to the length of these squeeze tubes, relative to their width, the accurate dispensing product, especially viscous product, is particularly difficult.

When dispensing product into containers, especially elongated squeeze tubes, it is known in the industry to be desirable to start the dispensing at the bottom of the container when it is placed on a support and to withdraw the dispensing nozzle as product is discharged into the container so that the manufacturer gets a "bottom to top" fill. This helps eliminate cavitation and the attended problems noted above. However, it has been found difficult to accurately match the rate that available volume is displaced in the container, as measured by the cross-section of the container times the linear rate of withdrawal of the dispensing nozzle, with the volume discharge rate of the product from the dispensing nozzle. Various cam and linkage systems are known to attempt this procedure. Equipment employing the cam and linkage systems are typically difficult to adjust for accurate volume flow rates. Moreover, it is difficult and time consuming to reset such filling apparatus for containers of different diameters and lengths.

SUMMARY OF THE INVENTION

It is an object of the present invention to provide new and useful dispensing apparatus for use in packaging a product.

It is another object of the present invention to provide dispensing apparatus which has a traveling dispensing nozzle that displaces a volume in a container to be filled that is matched to the flow rate of the dispensed product.

A further object of the present invention is to provide dispensing apparatus which provides a bottom-to-top fill of a container such that the dispensing nozzle head is always proximate to the fill level in the container yet is not contacted by dispensed product after being discharged into the container.

Still a further object of the present invention is to provide dispensing equipment with a travelling nozzle which reduces the likelihood of cavitation of product that is discharged into a container for packaging.

Yet another object of the present invention is to provide dispensing apparatus which avoids fouling of the dispensing apparatus by reducing the occurrences of overflowed product during the filling operation.

It is another object of the present invention to provide simplified dispensing equipment.

A further object of the present invention is to provide automated dispensing equipment that is more time efficient to allow greater through-put of containers to be filled.

Another object of the present invention is to provide dispensing equipment especially adapted for use with viscous materials.

According to the present invention, then, apparatus is provided that is adapted to be connected to a source of flowable material and which is operative to dispense a measured quantity of the material into a container. Broadly, the present invention includes a dispensing nozzle which is reciprocally movable in opposite first and second directions along a movement axis. A metering assembly is in fluid communication with the source of flowable material and with the dispensing nozzle so as to meter a selected quantity of the materials. Here, the metering assembly includes a metering cylinder having an interior, an metering element reciprocally movable into and out of the interior and a switching valve The metering assembly is thus switchable between a metering mode wherein the switching valve is in a first state operative to place an inlet of the metering assembly in fluid communication with the source of material and a second state operative to place an outlet of the metering assembly in fluid communication with the dispensing nozzle. As material flows into the interior of the metering assembly, when in the metering mode, the metering element is displaced a displacement distance from an inserted position to a retracted position. A meter element drive is provided that is operative when the switching valve is in the second state to drive the metering element the displacement distance from the retracted position to the inserted position thereby to displace material through the outlet and to dispense the selected quantity as determined by the displacement volume of the metering element. A lift bracket is provided and is mounted for common equidistant movement with said metering element as the metering element moves into and out of the interior of the metering cylinder. The dispensing nozzle is then interconnected to the lift bracket such that, when the metering element moves from the retracted position to the inserted position, the dispensing nozzle moves equidistantly in the first direction. A flexible conduit is used to interconnect the outlet of the metering assembly with the dispensing nozzle.

To accomplish equal flow rates, the present invention matches the cross-sectional area of the metering element with the cross-sectional area of the container. Here, the metering element can be a metering rod of uniform cross-section or a metering piston having a piston rod and an enlarged piston head. Accordingly, when the dispensing nozzle moves in the first direction, that is, out of the container, the rate of change of volume beneath the nozzle head matches the flow rate of product out of the metering assembly since the metering rod or piston head has the same cross-section as the container. To allow for use with containers of different cross-section, the present invention employs a plurality of different metering rods having different cross-sections that are in one-to-one correspondence of the cross-sections of the containers to be filled. Each such metering rod has its own, matched set of seals and bushings mountable in an end cap for attaching to the metering cylinder as a displacement set, so that the displacement sets may be readily interchanged to vary the flow rate to match the container cross-section.

Alternatively, different sets of metering cylinders, metering pistons and associated end caps and seals can be used to vary the volume of material metered and dispensed. Furthermore, the metering element drive is preferably adjustable in displacement distance to accommodate containers of different lengths.

The present invention also can include a nozzle drive that is operative to move the dispensing nozzle in the first direction independent of the movement of the metering element. Here, the nozzle drive is preferably a drive cylinder mounted for common movement with the lift bracket yet which is independently actuatable to move the dispensing nozzle an augmented distance in the first direction. The nozzle drive may also be operative to prevent the dispensing nozzle from moving in the second direction when the metering element is retracted the displacement distance yet which is independently actuatable to move the dispensing nozzle in the second direction a distance equal to the sum of the augmented distance and the displacement distance. Here again, it is preferred that the augmented distance be adjustable in magnitude.

To accomplish the relative movements described above with respect to the broad form of the present invention, the more specific embodiment of this invention employs a guide rail and first and second carriages which are slideably disposed on the guide rail for reciprocal movement therealong. The dispensing nozzle is then disposed on the second carriage and is reciprocally movable in opposite first and second directions along a movement axis. The metering assembly is as described above, with the metering element being rigidly connected to the first carriage. The metering element drive moves the metering element and, thus, the first carriage. A nozzle drive is also disposed on the first carriage and is operative to move the dispensing nozzle independently of movement of the first carriage.

In this more specific structure, the nozzle drive is preferably a drive cylinder independently actuatable to move the dispensing nozzle the augmented distance. The nozzle drive is also operative to prevent the dispensing nozzle from moving in the second direction when the metering rod is retracted the displacement distance yet is independently actuatable to move the dispensing nozzle in the second direction a distance equal to the sum of the augmented distance and the displacement distance. Here, the drive cylinder and the metering rod drive may each be hydraulic cylinders or air actuated cylinders. A limit stop is also provided to limit movement of the second carriage in a first carriage direction along said guide rail, and a buffer block is associated with the limit stop to cushion any impact of the carriage and its associated structures. Likewise, a second limit stop and a buffer may be provided for the first carriage when it moves in a second carriage direction along the guide rail opposite the first direction.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention is generally directed to dispensing apparatus used to dispense product into containers. It is particularly useful for packaging consumer products, but it is to be understood that the present invention may be employed equally well for industrial products. Of particular interest to the present is the packaging of materials having a medium to high viscosity. Such materials are difficult to package because they are prone to cavitation in the container and are otherwise susceptible to fouling the dispensing equipment and surrounding apparatus. As will hereinafter be described, the present invention employs a traveling nozzle that is inserted into a container and that is withdrawn to reveal a container of volume at a rate matching the flow rate of the discharged material so as to achieve a bottom-to-top fill.

Figure 1:
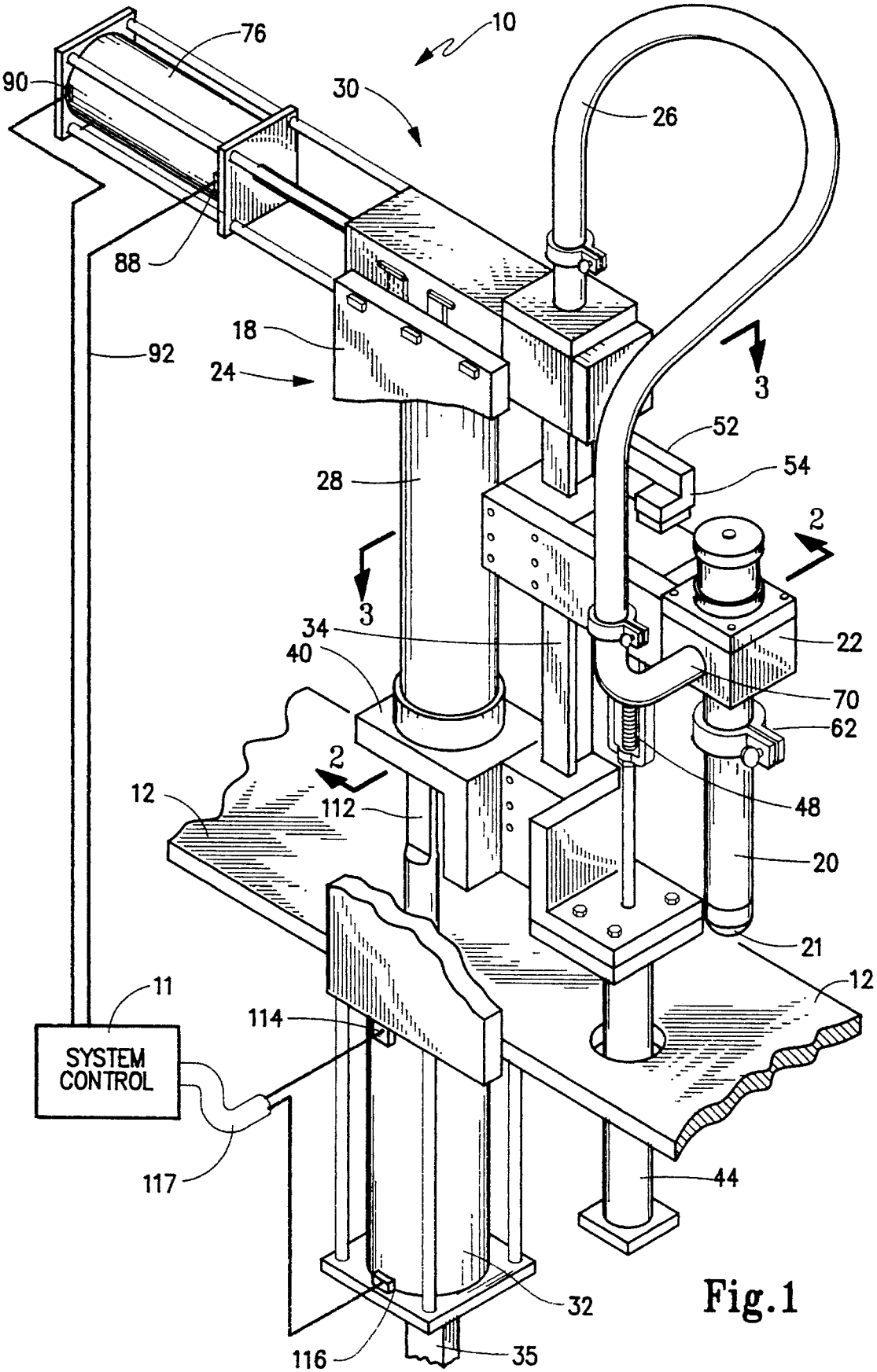
FIG. 1 is a perspective view of the dispensing apparatus according to the exemplary embodiment of the present invention.

The exemplary embodiment of the dispensing apparatus according to the present invention, then, is best shown in FIGS. 1–11(*a*) and (*b*). With particular reference to FIGS. 1, it may be seen that dispensing apparatus 10 is mounted on a support 12 that is also adapted to receive a container, such as container 14 shown on wheel support 16 in FIG. 4. Dispensing apparatus 10 includes a dispensing nozzle 20 attached to a nozzle mount 22 which is in turn connected to a metering assembly 24 by means of a flexible conduit or hose 26. Metering assembly 24 is rigidly supported by uprights 18 above support 12. As is shown in FIG. 1, metering assembly 24 includes a metering cylinder 28 and a switching valve 30, both of which are described in greater detail below. Metering cylinder 28 is operated by means of either an air actuated or hydraulically actuated cylinder 32 or such other cylinder drive that is known in the art.

Figure 2:
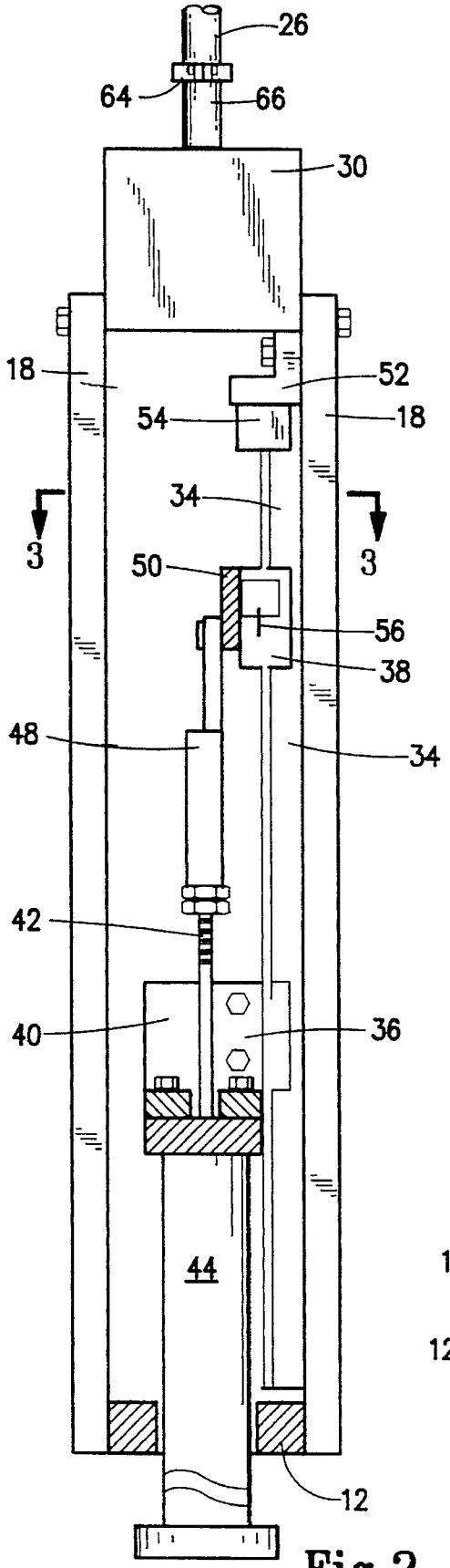
FIG. 2 is a cross-sectional view taken about lines 2—2 of FIG. 1.
Figure 3:
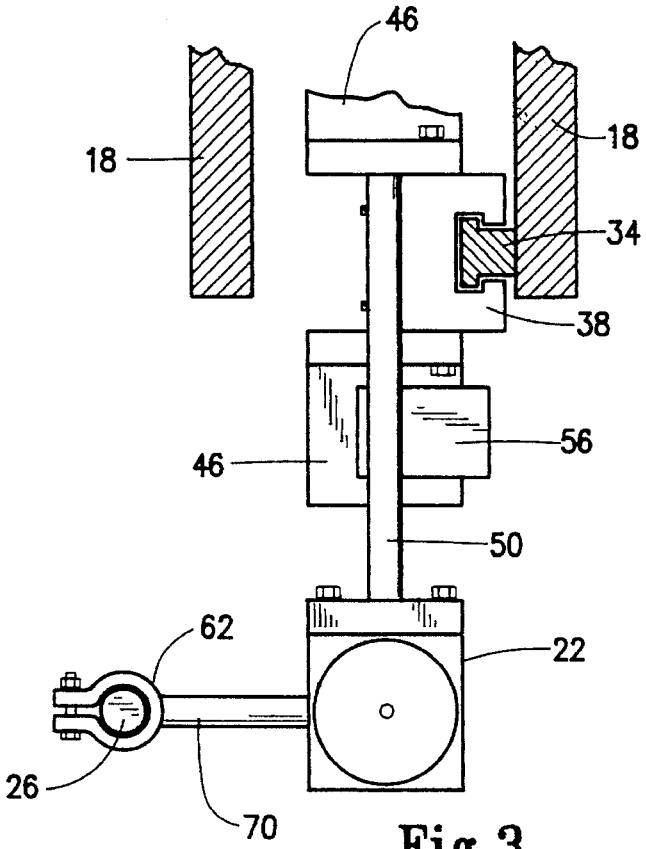
FIG. 3 is a cross-sectional view taken about lines 3—3 of FIG. 1.
Figure 4:
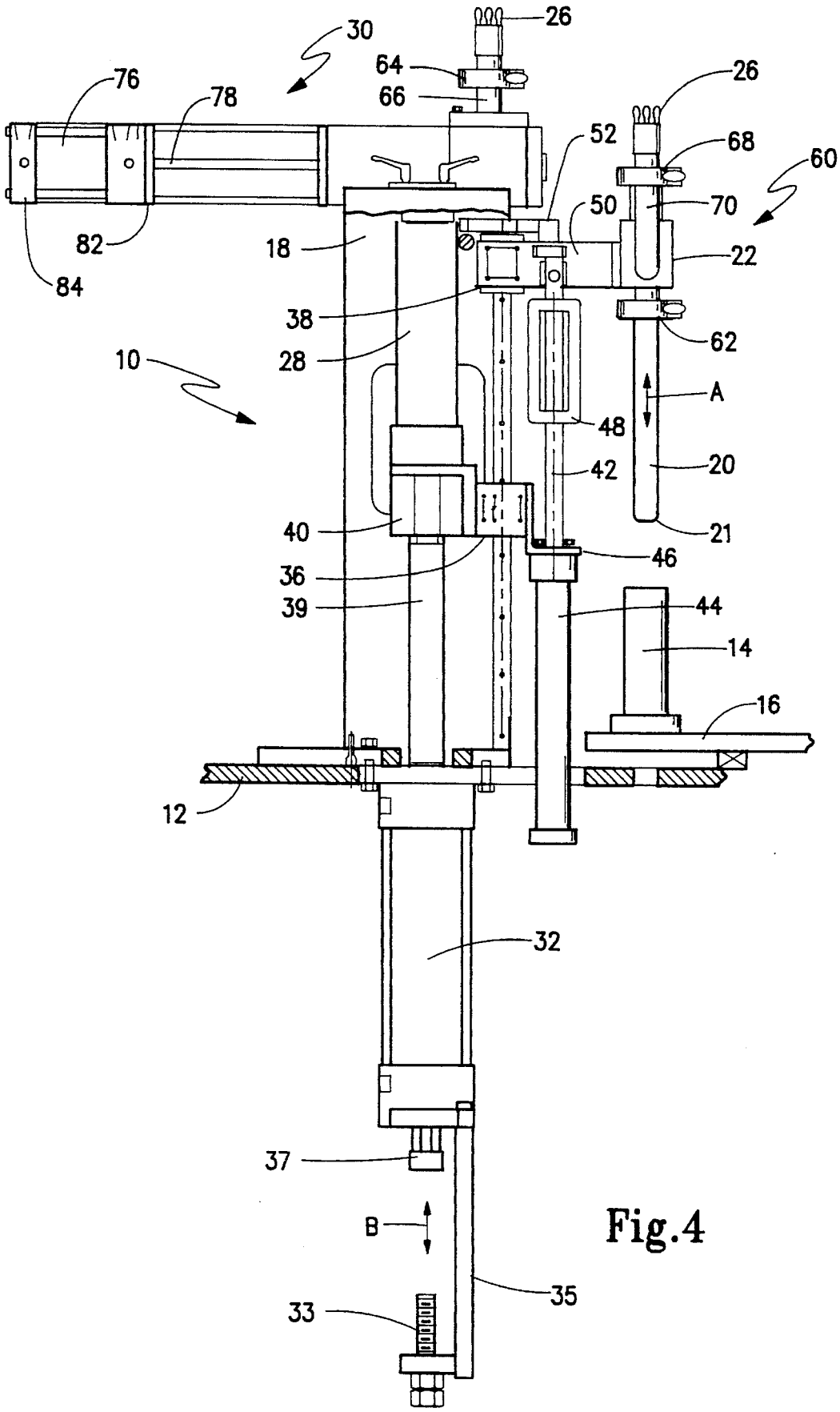
FIG. 4 is a side view in elevation showing the dispensing apparatus of FIG. 1.

As is shown in FIGS. 2–4, a guide rail 34 is slidably mounted to one of uprights 18 and first and second carriages 36 and 38 are slidably received thereon. A lift bracket 40 is rigidly mounted to first carriage 36 and is also mounted for common equidistant movement with metering rod 100 (as shown best in FIGS. 7 and 8) which reciprocates in metering cylinder 28. First and second carriages 36 and 38 are variably linked together by means of a piston rod 42 that is driven by air actuated cylinder 44 that is mounted by bracket 46 to first carriage 36. Here again other types of drives known in the art, including hydraulic cylinders, could be substituted for air cylinder 44. In any event, the distal end of piston rod 42 is received in a turnbuckle assembly 48 secured at an opposite end to a support arm 50 rigidly secured to second carriage 38. Cylinder 44, as described below, may be actuated to relatively move brackets 46, 50 and thus second carriage 38 relative first carriage 36 toward and away from first carriage 36 according to the throw distance of piston rod 42. A limit stop in the form of end stop block 52 and a shock absorbing pad 54 is mounted proximate to an uppermost of guide rail 34 adjacent switching valve 30 to cushion the impact of second carriage 38 and support arm 50 sliding therealong. Arm 56 is disposed on bracket 50, and arm 56 is oriented to contact pad 54 when second carriage 36 is in an uppermost position.

A dispensing nozzle assembly 60 is rigidly secured to support arm 50 so that nozzle assembly 60 reciprocates with movement of second carriage 38. Nozzle assembly 60 includes the nozzle 20 secured thereto by means of a clamp 62 and receives metered product or material from metering assembly 24 by means of the flexible hose 26 clamped by means of clamp 64 to output nozzle 66 of switching valve 30 and at the other end by clamp 68 to feed tube 70 of nozzle mount 22. This flexible conduit 26 allows dispensing nozzle 20 to reciprocate in the first and second directions of along a movement axis as shown by arrow "A" in FIG. 4 so that the free end 21 may move into and out of a container 14 to be filled. Turnbuckle 48 is adjustable to vary the depth that end 21 of nozzle 20 penetrated into the interior of container 14, that is, the distance above support 12 that dispensing will commence.

Figure 5:
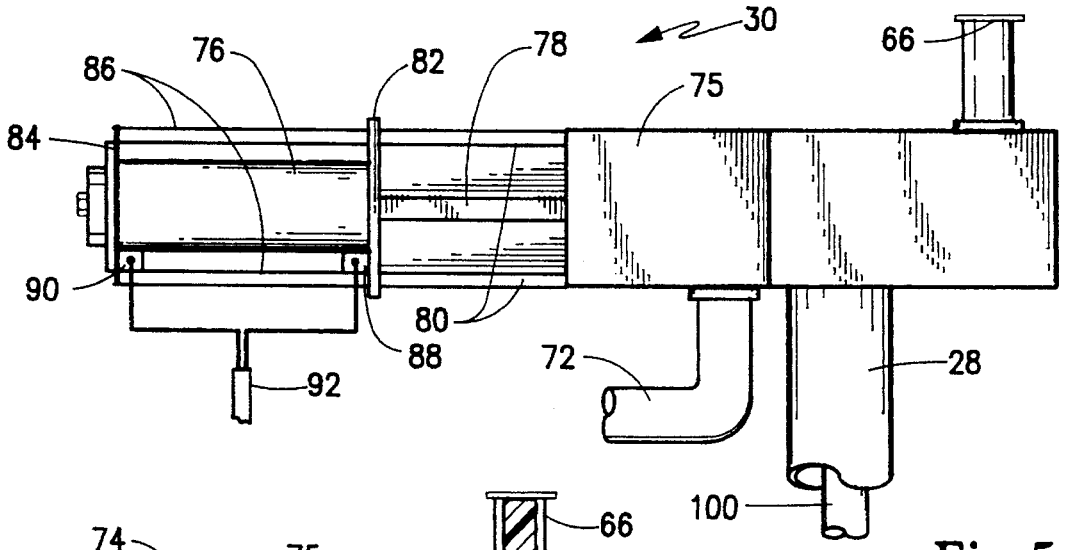
Fig.5 (PRIOR ART)
FIG. 5 is an enlarged side view in elevation showing a prior art metering assembly incorporated into the dispensing apparatus of FIG. 1.
Figure 6:
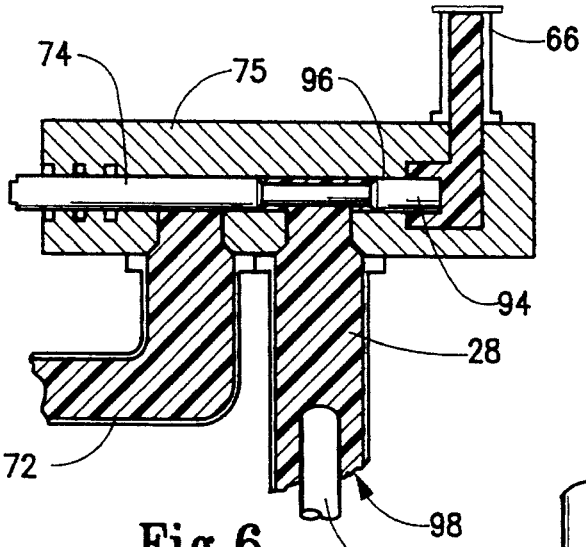
Fig.6 (PRIOR ART)
FIG. 6 is a side view in cross-section showing the switching valve employed in the prior art metering assembly of FIG. 5.

Metering assembly 28 is shown in greater detail in FIGS. 5 and 6. Here, the primary components may be those described in my earlier U.S. Pat. No. 4,974,755 issued Dec. 4, 1990 to Sonntag and entitled "DISPENSING VALVE ASSEMBLY AND SYSTEM". This disclosure of that patent is incorporated herein by reference. By way of general explanation, however, and as is shown in FIGS. 5 and 6, switching valve 30 has an inlet 72 connected to a source of material to be dispensed. A valve element 74 reciprocates in housing 75 of switching valve 30 and has a drive shaft 78 connected to an air cylinder 76 mounted to valve 30 by means of mounting rods 80. Air cylinder 76 is mounted between a pair of plates 82, 84 by means of mounting rods 86, and a position sensors 88 and 90 are provided for sensing the position of drive shaft 78 by means of cable 92. the status of sensors 88 and 90 are monitored by system control 11, shown in FIG. 1, that controls the timing of dispensing apparatus 10 by actuating the various drive cylinders.

Valve element 74 includes a head portion 94 and a waisted portion 96 so that, as valve element 74 reciprocates, piston head portion 94 and waisted portion 96 move into a first state that allows material to flow from inlet 72 into the interior 98 of metering cylinder 28. When metering cylinder 28 is filled, air cylinder 76 drives valve element 74 into a second state that places the interior 98 in fluid communication with outlet 66 allowing material to flow out of metering cylinder 28, past waisted portion 96 and piston head 94. The mount of this material, of course, is controlled by the displacement of a metering element here in the form of a metering rod 100 as described below. Moreover, retraction of head portion 94 toward the first state acts to "snuff-back" material in conduit 26 and nozzle 20. While the present invention has been described with respect to the valuing assembly 30 as described in my U.S. Pat. No. 4,974,755, it should be appreciated that other valve structures could be employed by the skilled practitioner in this field.

Figure 8:
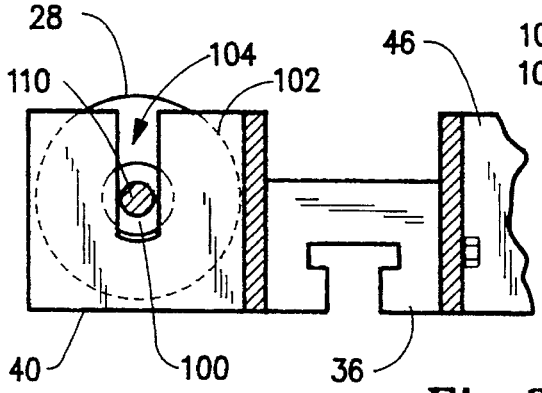
FIG. 8 is a cross-sectional view taken about lines 8—8 of FIG. 7.
Figure 7:
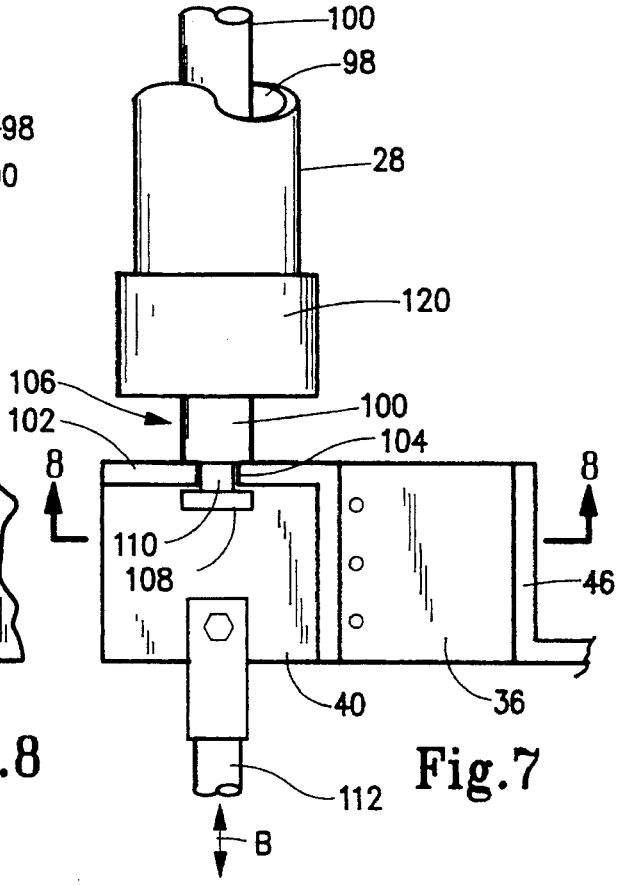
FIG. 7 is a side view in partial cross-section and partially broken-away of the metering cylinder and metering rod along with the lift bracket and first carriage of the dispensing apparatus shown in FIGS. 1–4.
Figure 17A:
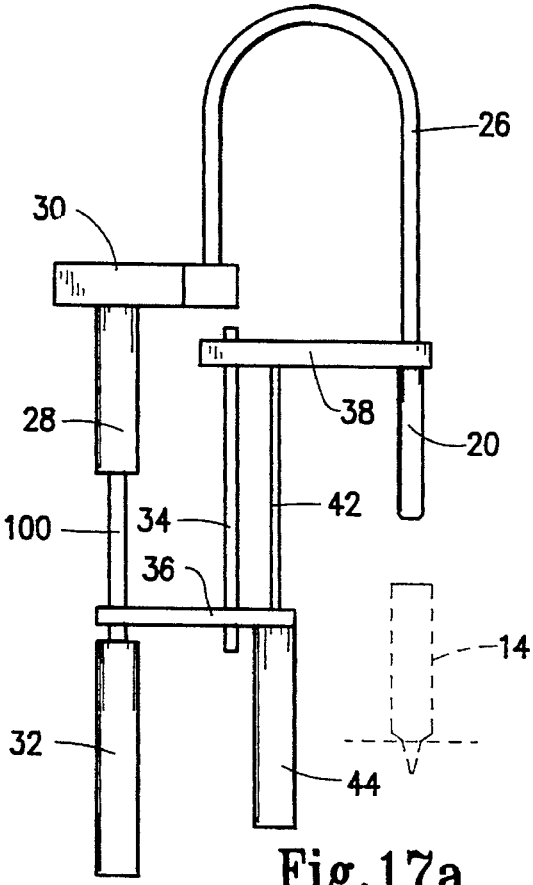
FIG. 17(*a*)–(*d*) are diagrammatic views showing the cycling of the dispensing apparatus according to the present invention.
Figure 17B:
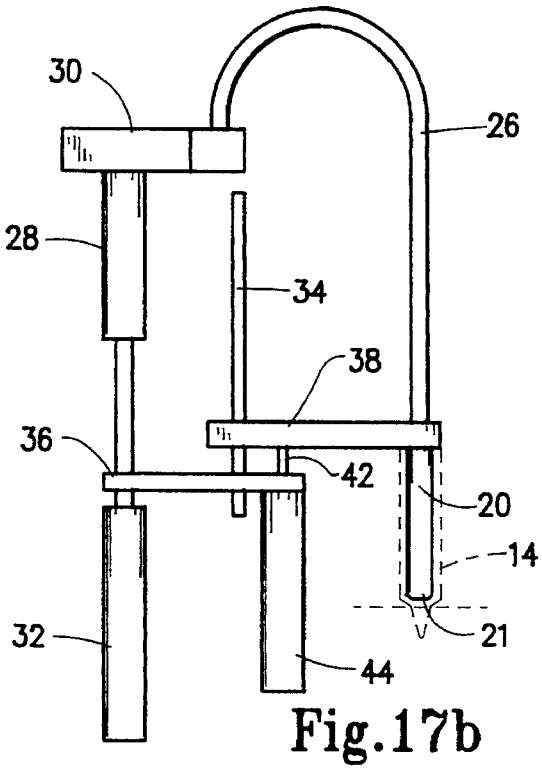
Figure 17C:
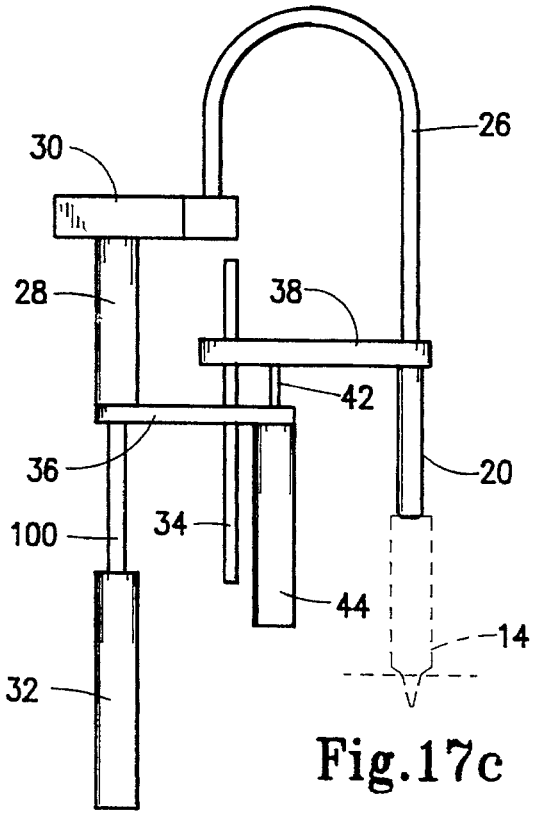
Figure 17D:
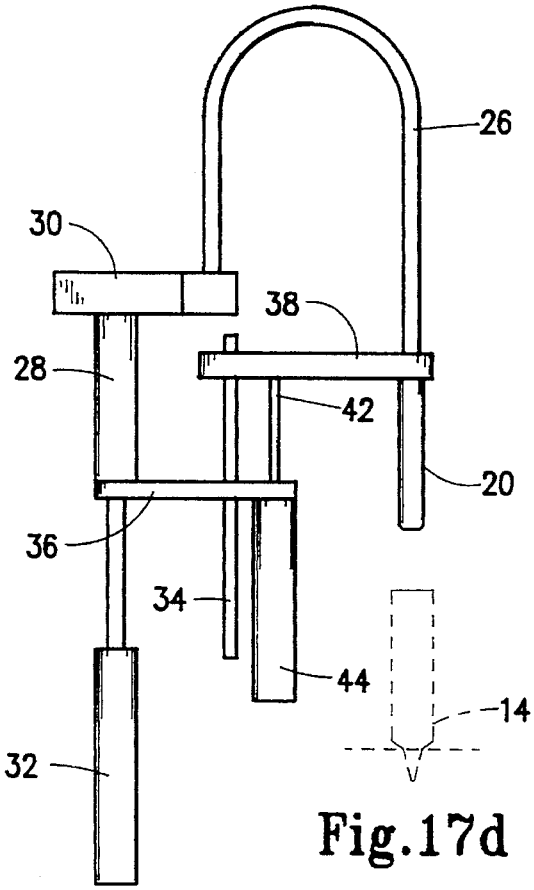

FIGS. 7 and 8 show the interconnection of mounting rod 100 of metering cylinder 28 to first carriage 36. Here, it may be seen that mounting plate 102 of lift bracket 40 is U-shaped in configuration having a recess 104 sized to receive an external end 106 of metering rod 100. End portion 106 has flange 108 and a neck 110 which receives mounting plate 102. Thus, metering rod 100 is reciprocally driven by means of lift bracket 40 which, in turn, is driven by drive rod 112 of cylinder drive 32 along a meter rod axis "B" shown in FIG. 7. Axis "B" is parallel to movement axis "A". Cylinder drive 32, as is shown in FIG. 1, is provided with sensors 114 and 116 to sense the relative position of the drive rod 112 and thus metering rod 100. This data is again communicated to system control 11 by cable 117. With reference again to FIG. 4, it may be seen that the metering rod throw or "stroke distance" may be increased or decreased. This is accomplished by means of adjusting screw 33 supported on bracket 35. Head 37 contacts screw 33 when metering rod 100 is retracted from cylinder 28 so that varying the projection of screw 33 in the metering rod axis "B" adjusts the maximum retraction of the metering rod.

Figure 9:
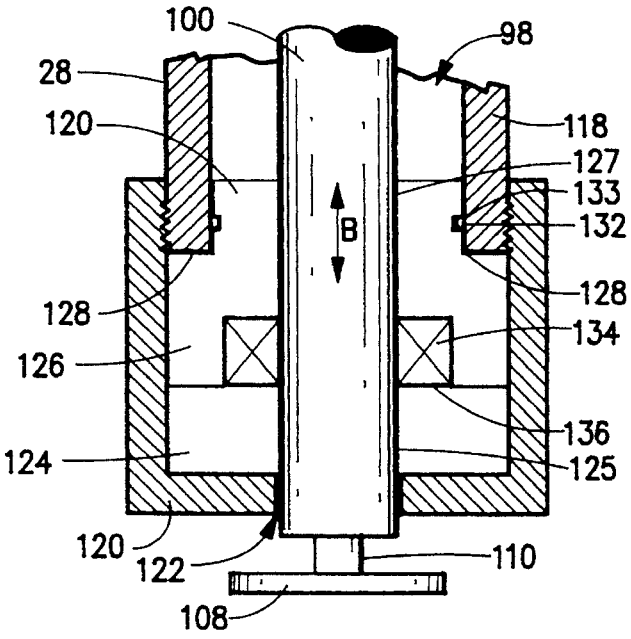
FIG. 9 is an enlarged cross-sectional view of the metering rod, rod housing and rod seal structure according to the exemplary embodiment of the present invention.

The reciprocal mounting of metering rod 100 in metering cylinder 28 is best shown in FIG. 9. Here, it may be seen that metering cylinder 28 includes a cylindrical casing 118 onto which is threadably received an end cap 120 having a bore 122 sized for close-fitted insertion of metering rod 100. A cylinder bushing 124 is mounted in end cap 120, and a seal ring 126 is positioned between cylinder bushing 124 and casing 118. Seal ring 126 includes a shoulder 128 adapted to abut the end of casing 118, and a neck portion 130 of seal ring 126 extends into interior 98 thereof. Cylinder bushing 124 and seal ring 126 respectively have openings 125 and 127 therethrough which are axially aligned and sized and adapted for close-fitted insertion of metering rod 100. In order to seal this structure, a bushing seal 132 extends in a toroidal channel 133 around neck portion 130 so that seal ring 126 may be sealed against the interior sidewall of casing 118. Rod seal 134 is positioned in toroidal channel 136 and engages the sliding exterior surface of metering rod 100 to maintain a sliding seal thereagainst.

Figure 10:
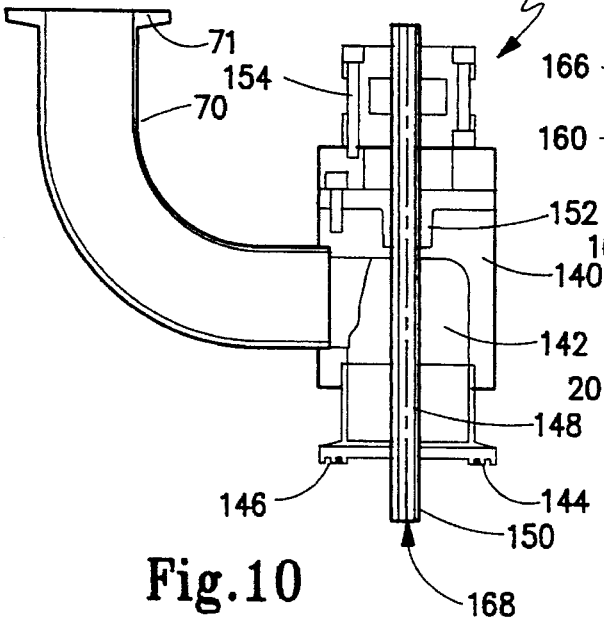
FIG. 10 is an end view partially broken-away and in partial cross-section showing the dispensing nozzle mount of the dispensing apparatus shown in FIGS. 1–4.

Nozzle assembly 60 is best shown in FIG. 10 (without nozzle 20 mounted thereon). Here, nozzle assembly 60 includes a housing 140 having an interior 142 in fluid communication with feed tube 70 that terminates in a flange 71 for attachment to hose 26 by means of clamp 68. Nozzle mount 144 is disposed on housing 140 and includes a seal 146 adapted to seal against nozzle 20 as described below. A stopper rod 148 extends longitudinally through housing 140, including nozzle mount 144, and terminates at a first end 150 proximate to nozzle mount 144 and is reciprocated by an air cylinder 154 that is disposed on housing 140. Seal 152 is located in housing 140 and acts to maintain a sliding seal with rod 148.

Figure 11A:
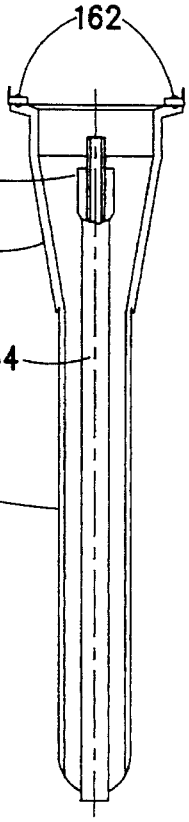
FIG. 11(*a*) and FIG. 11(*b*) show an exemplary embodiment of a dispensing nozzle used with the dispensing apparatus of the present invention and connectable to the nozzle mount of FIG. 10.
Figure 11B:
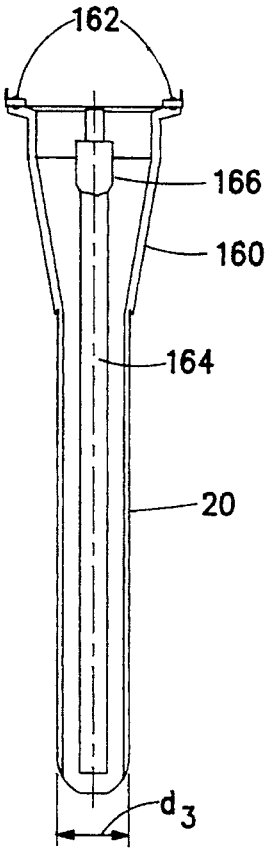

Nozzle 20, shown in FIGS. 11(*a*) and 11(*b*) has a nozzle housing 160 that terminates in upwardly turned rim 162 adapted to be positioned in mated engagement with nozzle mount 144 shown in FIG. 10. Nozzle 20 is secured in the mounted state by means of clamp 62 shown in FIGS. 1 and 4. A movable nozzle stopper 164 extends longitudinally through nozzle 20 and terminates in a male nipple coupling 166 that is sized and adapted for mated engagement with female nipple coupling 168 of rod 148. In operation, nozzle stopper 164 may be moved from the position shown in FIG. 11(*a*) to the position shown in FIG. 11(*b*) to selectively close and open nozzle 20. This is accomplished by air cylinder 154 and rod 148. As is known, it is possible to make rod 148 hollow and employ a suitable jet of air or other gas to remove product drips from the end of nozzle 20 after the filing cycle is completed.

Figure 14:
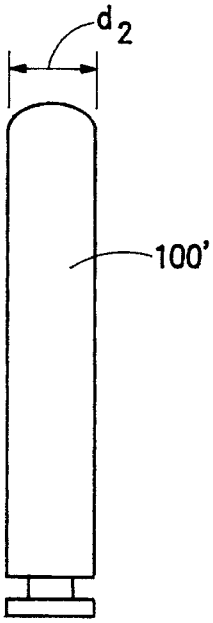
FIG. 14 is a side view in elevation of an alternative metering rod matched in size to the dispensing nozzle of FIG. 13.
Figure 12:
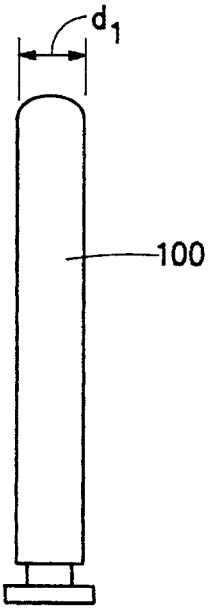
FIG. 12 is a side view in elevation showing a metering rod matched to the dispensing nozzles of FIGS. 11(*a*) and 11(*b*)

It should be appreciated from the foregoing that the amount of product dispensed by metering assembly 24 is determined by the distance of throw of metering rod 100 within metering cylinder 28 and by the cross-section of metering rod 100. This, of course, is the displacement volume of the metering rod within metering cylinder 28. This amount may be varied conveniently by employing metering rods of different cross-sections. Thus, the present invention contemplates employing interchangeable metering rods which may be mounted in mounting plate 102 and slidably received in the interior 98 of casing 118 of metering cylinder 28. Thus, for example, metering rod 100, as is shown in FIG. 12, is cylindrical in shape and has a diameter "$d_1$", which thus determines its cross-section. A larger metering rod 100' is shown in FIG. 14 and has a larger diameter "$d_2$". Accordingly, for a given throw distance, metering rod 100' would dispense more product through switching valve 30. To allow interchangeability between metering rods 100 and 100', it is simply sufficient to provide a complimentary rod seals cylinder bushings and seal rings for a respective metering rod with each of these metering sets being sized for mounting into a standard end cap 120.

Figure 13:
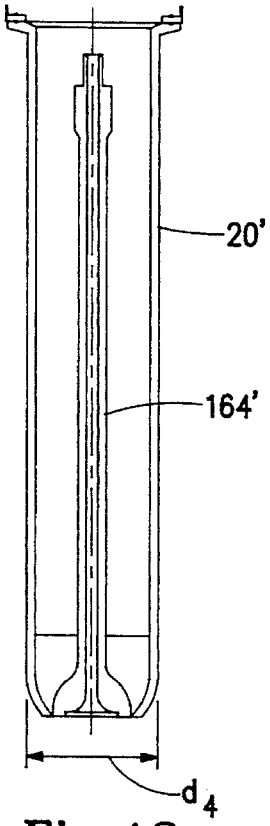
FIG. 13 is an alternative view of the dispensing nozzle that is larger in size than the dispensing nozzle of FIGS. 11(*a*) and 11(*b*) and which is attachable to the dispensing nozzle mount of FIG. 10.
Figure 15:
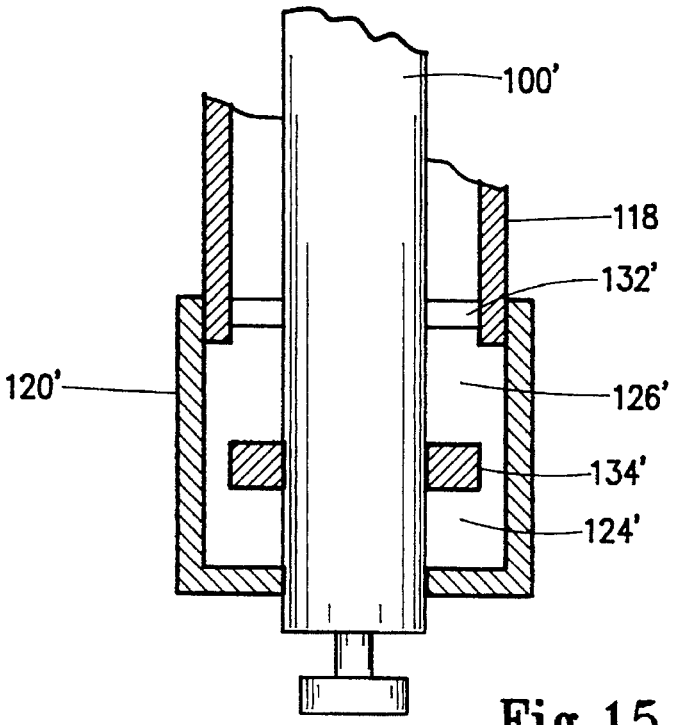
FIG. 15 is a cross-sectional view similar to FIG. 9 but showing a displacement including a rod seal sealing and bushing for the metering rod of FIG. 14.

Moreover, in the present invention, it is preferred to match the cross-sectional dimension of the nozzle 20 with the cross-sectional dimension of each metering rod such as metering rod 100, during use. With reference to FIGS. 11(*a*), 11(*b*) and 12, it may be seen that nozzle 20 has a diameter of "$d_3$" that is approximately the same as "$d_1$" for metering rod 100. Comparing FIG. 13 to FIG. 14, it may be seen that dispensing nozzle 20' receives movable nozzle stopper 164' and has a diameter "$d_4$" that is approximately equal to the diameter "$d_2$" of metering rod 100' shown in FIG. 14. In FIG. 15, it may be seen that alternative end cap 120' threadably mounts on casing 118 and contains alternative cylinder bushing 124', seal ring 126', bushing seal 132' and rod seal 134', all sized to receive enlarged metering rod 100'.

Regardless of whether the actual nozzle cross-sections are equally matched, the present invention specifically contemplates matching the cross-sectional area of the container 14 to be filled with the cross-sectional area of the metering rod 100. Thus, for a bottom-to-top fill dispensing nozzle 20 will move out of container 14 at a volume fill rate that exactly matches the rate of product dispensed as metering rod 100 moves into metering cylinder 28 where the respective displacement distance of metering rod 100 and dispensing nozzle 20 are the same during fill. This is accomplished by linking the displacement of dispensing nozzle 20 in a nozzle direction "A" with the movement of metering rod 100 and brackets 40 and 46 mounted to first carriage. This is accomplished by the utilization of guide rail 34, first and second carriages 36, 38 and their associated brackets along with its auxiliary drive cylinder 44.

Figure 16A:
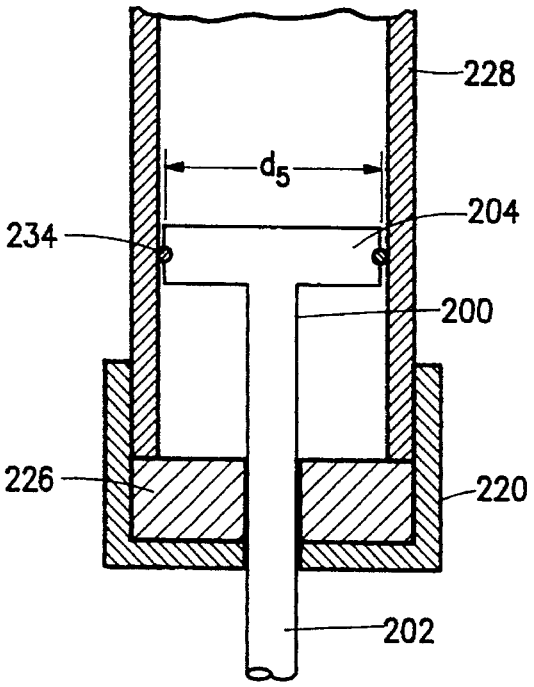
FIGS. 16(*a*) and 16(*b*) are side views in partial cross-section showing alternative structure of the metering cylinder with piston elements.
Figure 16B:
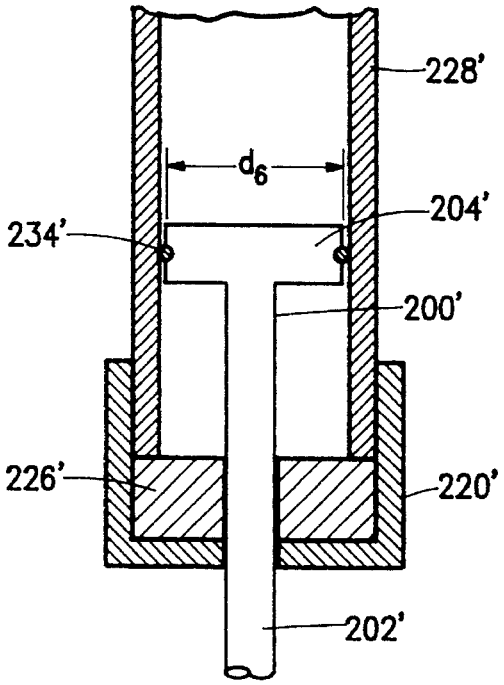

It should also be appreciated that variable dispensing of material may be accomplished by using metering elements other than metering rods, such as metering rods 100 and 100', described above. An example for illustrative purposes is shown in FIG. 16(*a*). Here, it may be seen that the metering element is in the form of a metering piston 200 which includes a piston rod 202 and an enlarged piston head 204 which is slidably received in metering cylinder 228. Piston head 204 has a diameter "$d_5$" with metering cylinder 228 having a slightly larger diameter, but yet a diameter such that piston head 204 is sized and adapted for close-fitted slidable engagement therewith. Metering piston 200 is secured within metering cylinder 228 by means of end cap 220 threadably received on to the end of metering cylinder 228. Metering cylinder 220 includes a bushing 226 that slidably mounts piston rod 202. A seal 234 extends around piston head 204 to seal against metering cylinder 220. Thus, metering cylinder 228 will meter and dispense an amount of material equal to the cross-sectional area of piston head 204 multiplied by the throw distance of piston rod 202, and thus the throw distance of piston head 204. Here, it should be appreciated that cylinder 228 and metering piston 200 form a metering set, along with the associated end cap 220, bushing 226, and seal 234.

Variance in the amount of dispensed material where a metering piston is used must be accomplished by varying the diameter of the piston head and, correspondingly, the internal diameter of the metering cylinder. Again for purposes of illustration, a second metering set utilizing a metering piston is shown in FIG. 16(*b*). Here, the metering element is in the form of a metering piston 200' which includes a piston head 204' having a smaller diameter "$d_6$" than the diameter "$d_5$" of metering piston 200. Accordingly, metering cylinder 228' has a smaller diameter than metering cylinder 228 but, here again, piston head 204' is sized for close-fitting slidable engagement in metering cylinder 228'. Cylinder head 204' is reciprocated by means of piston rod 202' which passes through end cap 220' and bushing 226'. Seal 234' is provided around piston head 204'. Accordingly, changing the metering sets shown in FIGS. 16(*a*) and FIG. 16(*b*) varies the amount of material dispensed for an equal throw distance of piston rods 202 and 202', respectively. Of course, any number of metering sets may be employed to vary the quantity to be dispensed. In such event, it is desired that the cross-sectional area of the piston head, such as piston heads 204, 204', be matched to the cross-sectional area of the container to be filled.

To understand the operation of the present invention, reference may be made to the diagrams shown in FIGS. 17(*a*)–17(*d*) which show a cycle of operation. In FIG. 17(*a*), it may be seen that cylinder drive 32 has withdrawn metering rod 100 completely out of metering cylinder 28 to a retracted position thus allowing metering cylinder 28 to fill with material to be dispensed. At this point in time, first carriage 36 is at its lowermost position on guide rail 34. Cylinder 44 has been actuated to drive piston rod 42 upwardly to place slide second carriage 38 at an uppermost position on guide rail 34 so that first and second carriages 36, 38 are spaced the furthest distance apart, relative to one another. In this position, nozzle 20 is at its most elevated position so that a container 14 may be moved into position for fill. At this point, system control 11 switches switching valve 30 from the metering mode to the discharge mode.

With reference to FIG. 17(*b*), as switching valve 30 is placed in the discharge mode, cylinder 44 is actuated to retract piston rod 42 thus moving carriage 38 downwardly to its closest relative spacing to carriage 36 along guide rail 34. Dispensing nozzle thus moves interiorly of container 14 so that its end 21 is located at the bottom of container 14. At this point, cylinder drive 32 is activated to drive carriage 36 upwardly along guide rail 34 thus also inserting metering rod 100 into metering cylinder 28 the displacement distance. As this happens, product is dispensed through valve assembly 30 and conduit 26 so that it is dispensed out of dispensing nozzle 20. However, due to the coupling of carriage 38 through cylinder 44 and drive rod 42, carriage 38 moves linearly upwardly a distance equal to the displacement distance of extension of metering rod 100. Accordingly, since dispensing nozzle 20 is rigidly secured with respect to carriage 38, nozzle 20 moves equidistantly with metering rod 100, as is shown in FIG. 17(*c*). Not only are the distances the same, but the rate of displacement is equal. Thus, as a volume of material is dispensed from metering cylinder 28, an equal volume is displaced in container 14 due to the matched cross-section of metering rod 100 with respect to the cross-section of container 14. Product is accordingly dispensed into container 14 in a bottom-to-top fill at a rate equal to the withdrawal of dispensing nozzle 20 therefrom so that air cavitation and equipment fouling is avoided.

In order to index a container 14 away from the filling station defined by nozzle 20, cylinder 44 is next actuated to advance drive rod 42 outwardly, as is shown in FIG. 17(*d*). This now moves dispensing nozzle 20 an augmented distance out of container 14 by moving carriage 38 away from slide carriage 36 along guide rail 34. The cycle is then repeated by maintaining a positive pressure on drive cylinder 44 while retracting metering rod 100 from metering cylinder 28 as is shown in FIG. 17(*a*). This allows the manufacturer to simultaneously index from a filled container away from nozzle 20 while moving an empty container 14 into position and simultaneously filling metering cylinder 28 with product to be dispensed.

From the foregoing, it should be appreciated that substantial advantages obtained from the heretofore described invention. On the one hand, the dispensing of a measured quantity serially into a plurality of individual containers for packaging product can be accomplished at an increased rate since the metering of the quantity to be dispensed occurs simultaneously with the indexing of the containers for packaging. Moreover, by providing for the dispensing of the product in a volume and rate in one-to-one correspondence with the withdrawal of the dispensing nozzle, a more accurate fill may be accomplished with reduced risk of equipment fouling. Further, it is a simple matter to interchange metering rods (and the associated rod seals, ring seals, etc.) as well as the dispensing nozzle to correspond to the selected cross-section of a container to be filled. No complicated camming or gearing is necessary to insure the equal travel of the dispensing nozzle and the metering rod since axes "A" and "B" are parallel and, should the stroke of the metering rod be adjusted by screw 33, this adjustment automatically adjusts the stroke of the dispensing nozzle. This greatly simplifies the complexity of the filling apparatus while maintaining the advantages of a uniform bottom-to-top fill.

Accordingly, the present invention has been described with some degree of particularity directed to the exemplary embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. Apparatus adapted to be connected to a source of flowable material and operative to dispense a measured quantity of material into a container, comprising:

(a) a dispensing nozzle reciprocally movable in opposite first and second directions along a movement axis;

(b) a metering assembly including a metering cylinder having an interior, a metering element reciprocally movable into and out of the interior of said metering cylinder and a switching valve, said metering assembly switchable between a metering mode wherein said switching valve is in a first state operative to place an inlet of said metering assembly in fluid communication with the source of material so that material flows into the interior of the metering cylinder thereby displacing said metering element a displacement distance from an inserted position to a retracted position and a discharge mode wherein said switching valve is in a second state operative to place an outlet of said metering assembly in fluid communication with said dispensing nozzle;

(c) a metering element drive operative when said switching valve is in the second state to drive said metering element the displacement distance from the retracted position to the inserted position thereby displacing material through the outlet of said metering cylinder and thereby to dispense the selected quantity of material from said dispensing nozzle; and (d) a lift bracket mounted for common equidistant movement with said metering element as said metering element moves into and out of the interior of said metering cylinder, said dispesing nozzle fixedly interconnected to said lift bracket such that, when said metering element moves from the retracted position to the inserted position, said dispensing nozzle moves equidistantly in the first direction.

2. Apparatus according to claim 1 including a nozzle drive operative to move said dispensing nozzle in the first direction independently of movement of said metering element.

3. Apparatus according to claim 2 wherein said nozzle drive is a drive cylinder mounted for common movement with said lift bracket yet is independently actuatable to move said dispensing nozzle an augmented distance in the first direction.

4. Apparatus according to claim 3 wherein said nozzle drive is operative to prevent said dispensing nozzle from moving in the second direction when said metering element is retracted the displacement distance yet is independently actuatable to move said dispensing nozzle in the second direction a distance equal to the augmented distance and the displacement distance.

5. Apparatus according to claim 3 wherein the augmented distance is adjustable in magnitude.

6. Apparatus according to claim 1 including a flexible conduit interconnecting the outlet of said metering assembly and said nozzle for fluid communication therebetween.

7. Apparatus according to claim 1 wherein said metering element is in the form of a rod having a uniform cross-sectional area and wherein said metering cylinder includes an end cap removably mounted thereto and operative to slideably receive said metering rod and to enclose the interior of said metering cylinder, and including seal means in said end cap for maintaining a seal against said metering rod during reciprocal motion thereof.

8. Apparatus according to claim 7 including a plurality of metering rods, end caps and seal means for interchangeable mounting as metering sets to said metering cylinder, said metering rods having different cross-sectional areas whereby different volumes in the interior of said metering cylinder will be displaced thereby during reciprocal movement of the respective metering rod so that the selected quantity of material to be dispensed may be varied.

9. Apparatus according to claim 8 including a plurality of dispensing nozzles adapted for interchangeable mounting with respect to said lift bracket, said dispensing nozzles having different cross-section areas in equal correspondence to the cross-sectional areas of respective ones of the plurality of said metering rods.

10. Apparatus according to claim 1 wherein said metering cylinder has a cross-sectional area and wherein said metering element is a metering piston having an enlarged piston head reciprocally received in close-fitted slidable engagement in said metering cylinder.

11. Apparatus according to claim 10 including a plurality of metering cylinders having different cross-sectional areas and including a plurality of different metering pistons, there being a respective metering piston sized for slidable engagement in a respective metering cylinder to define a metering set, said metering sets being interchangeable so that the selected quantity of material to be dispensed may be varied.

12. Apparatus according to claim 1 wherein said container has a defined cross-section, said metering element having an equal rod cross-section as the defined cross-section.

13. Apparatus according to claim 1 wherein said switching valve is operative to snuff back material in said dispensing nozzle after the selected quantity has been dispensed therefrom.

14. Apparatus adapted to be connected to a source of flowable material and operative to dispense a measured quantity of material into a container, comprising:

(a) a guide rail;

(b) first and second carriages slideably disposed on said guide rail for reciprocal movement therealong;

(c) a dispensing nozzle disposed on said second carriage and reciprocally movable in opposite first and second directions along a movement axis;

(d) a metering assembly including a metering cylinder having an interior, a metering rod rigidly connected to said first carriage and reciprocally movable into and out of the interior of said metering cylinder and a switching valve, said metering assembly switchable between a metering mode wherein said switching valve is in a first state operative to place an inlet of said metering assembly in fluid communication with the source of material so that material flows into the interior of the metering cylinder thereby displacing said metering rod a displacement distance from an inserted position to a retracted position and a discharge mode wherein said switching valve is in a second state operative to place an outlet of said metering assembly in fluid communication with said dispensing nozzle;

(e) a metering rod drive operative when said switching valve is in the second state to drive said metering rod the displacement distance from the retracted position to the inserted position thereby displacing material through the outlet of said metering cylinder and thereby to dispense the selected quantity of material from said dispensing nozzle; and (f) a nozzle drive disposed on said first carriage and operative to move said dispensing nozzle independently of movement of said first carriage.

15. Apparatus according to claim 14 wherein said nozzle drive is a drive cylinder independently actuatable to move said dispensing nozzle an augmented distance in the first direction.

16. Apparatus according to claim 15 wherein said nozzle drive is operative to prevent said dispensing nozzle from moving in the second direction when said metering rod in retracted the displacement distance yet is independently actuatable to move said dispensing nozzle in the second direction a distance equal to the augmented distance and the displacement distance.

17. Apparatus according to claim 15 wherein the augmented distance is adjustable in magnitude.

18. Apparatus according to claim 15 wherein said drive cylinder and said metering rod drive are each selected from a group consisting of hydraulic cylinders and air actuated cylinders.

19. Apparatus according to claim 14 including a limit stop operative to limit movement of said second carriage in a first carriage direction along said guide rail, and including a buffer block associated with said limit stop.

20. Apparatus according to claim 14 including a flexible conduit interconnecting the outlet of said metering assembly and said nozzle for fluid communication therebetween.

21. Apparatus adapted to be connected to a source of flowable material and operative to dispense a measured quantity of material into a tubular container that has a uniform container cross-section along its length, comprising:

(a) a support for said container;

(b) a dispensing nozzle reciprocally movable in opposite first and second directions along a movement axis into and out of said container when positioned on said support;

(c) a metering assembly including a metering cylinder having an interior, a metering rod reciprocally movable into and out of the interior of said metering cylinder and a switching valve, said metering assembly switchable between a metering mode wherein said switching valve is in a first state operative to place an inlet of said metering assembly in fluid communication with the source of material so that material flows into the interior of the metering cylinder thereby displacing said metering rod a displacement distance from an inserted position to a retracted position and a discharge mode wherein said switching valve is in a second state operative to place an outlet of said metering assembly in fluid communication with said dispensing nozzle, said metering rod having a rod cross-section selected to be equal to the container cross-section;

(d) a metering rod drive operative when said switching valve is in the second state to drive said metering rod the displacement distance from the retracted position to the inserted position thereby displacing material through the outlet of said metering cylinder at a rod volume displacement rate and thereby to dispense the selected quantity of material from said dispensing nozzle; and (e) a lift bracket mounted for common equidistant movement with said metering rod as said metering rod moves into and out of the interior of said metering cylinder, said dispensing nozzle interconnected to said lift bracket such that, when said metering rod moves from the retracted position to the inserted position, said dispensing nozzle moves equidistantly in the first direction out of said cylinder thereby to move out of said container at a container volume rate equal to said rod volume displacement rate.

22. Apparatus according to claim 21 including a nozzle drive operative to move said dispensing nozzle in the first direction independently of movement of said metering rod.

23. Apparatus according to claim 22 wherein said nozzle drive is a drive cylinder mounted for common movement with said lift bracket yet is independently actuatable to move said dispensing nozzle an augmented distance in the first direction.

24. Apparatus according to claim 23 wherein said nozzle drive is operative to prevent said dispensing nozzle from moving in the second direction when said metering rod is retracted the displacement distance yet is independently actuatable to move said dispensing nozzle in the second direction into said container a distance equal to the augmented distance and the displacement distance so that said dispensing nozzle is moved into said container when said container is positioned on said support.

25. Apparatus according to claim 23 wherein the augmented distance is adjustable in magnitude.

26. Apparatus according to claim 21 wherein said metering cylinder includes an end cap removably mounted thereto and operative to slideably receive said metering rod and to enclose the interior of said metering cylinder, said end cap including seal means for maintaining a seal against said metering rod during reciprocal motion thereof.

27. Apparatus according to claim 26 adapted to be used to fill different tubular containers respectively having different uniform container cross-sections, including a plurality of metering rods, end caps and seal means for interchangeable mounting to said metering cylinder, said metering rods having different cross-sectional areas in one-to-one correspondence with the different uniform container cross-sections whereby different volumes in the interior of said metering cylinder will be displaced thereby during reciprocal movement of the respective metering rod so that the selected quantity of material to be dispensed may be varied.

28. Apparatus according to claim 27 including a plurality of dispensing nozzles interchangeably interconnectable to said lift bracket, said dispensing nozzles having different cross-section areas in one-to-one correspondence to the cross-sectional areas of respective ones of the plurality of said metering rods and the different uniform container cross-sections.

29. Apparatus according to claim 21 including a guide rail and first and second carriages slideably disposed on said guide rail for reciprocal movement therealong, said lift bracket secured to said first carriage and, said dispensing nozzle being disposed on said second carriage, and including a mechanical linkage interconnecting said first and second carriages.

30. Apparatus according to claim 29 wherein said mechanical linkage includes a nozzle drive operative to relatively position said first and second carriages with respect to one another.

31. Apparatus adapted to be connected to a source of flowable material and operative to dispense a measured quantity of material into a container, comprising:

(a) a dispensing nozzle reciprocally movable in opposite first and second directions along a movement axis;

(b) a metering assembly including a metering cylinder having an interior, a metering element reciprocally movable into and out of the interior of said metering cylinder and a switching valve, said metering assembly switchable between a metering mode wherein said switching valve is in a first state operative to place an inlet of said metering assembly in fluid communication with the source of material so that material flows into the interior of the metering cylinder thereby displacing said metering element a displacement distance from an inserted position to a retracted position and a discharge mode wherein said switching valve is in a second state operative to place an outlet of said metering assembly in fluid communication with said dispensing nozzle;

(c) a metering element drive operative when said switching valve is in the second state to drive said metering element the displacement distance from the retracted position to the inserted position thereby displacing material through the outlet of said metering cylinder and thereby to dispense the selected quantity of material from said dispensing nozzle; and (d) a lift bracket mounted for common equidistant movement with said metering element as said metering element moves into and out of the interior of said metering cylinder, said lift bracket including a guide rail and a first carriage slidably disposed on said guide rail for reciprocal movement therealong, said life bracket secured to said first carriage, said dispensing nozzle interconnected to said lift bracket such that, when said metering element moves from the retracted position to the inserted position, said dispensing nozzle moves equidistantly in the first direction.

32. Apparatus according to claim 31 including a second carriage slideably disposed on said guide rail for reciprocal movement therealong, said dispensing nozzle being disposed on said second carriage, and including a mechanical linkage interconnecting said first and second carriages.

33. Apparatus according to claim 32 wherein said mechanical linkage includes a nozzle drive operative to relatively position said first and second carriages with respect to one another.

34. Apparatus according to claim 32 including a limit stop operative to limit movement of said second carriage in a first carriage direction along said guide rail, and including a buffer block associated with said limit stop.

* * * * *